United States Patent [19]

Pay

[11] Patent Number: 4,679,735

[45] Date of Patent: Jul. 14, 1987

[54] ELECTROSTATIC SPRAYING APPARATUS

[75] Inventor: Christopher C. Pay, Woodhall Spa, England

[73] Assignee: Crop Control Products Limited, Lincoln, England

[21] Appl. No.: 847,238

[22] Filed: Apr. 2, 1986

[30] Foreign Application Priority Data

Apr. 3, 1985 [GB] United Kingdom ..... 8508670

[51] Int. Cl.[4] ..... B05B 5/02

[52] U.S. Cl. ..... 239/708; 239/120; 239/288.5

[58] Field of Search ..... 239/690, 693, 697, 698, 239/708, 104, 120–122, 288, 288.3, 288.5

[56] References Cited

U.S. PATENT DOCUMENTS 4,440,349 4/1984 Sickles et al. ..... 239/708

FOREIGN PATENT DOCUMENTS 1125358 6/1982 Canada ..... 239/690
2343513 10/1977 France ..... 239/697
2132917 7/1984 United Kingdom ..... 239/690
2140711 12/1984 United Kingdom ..... 239/690

*Primary Examiner*—Andres Kashnikow
*Assistant Examiner*—Michael J. Forman
*Attorney, Agent, or Firm*—David G. Rosenbaum

[57] ABSTRACT

Electrostatic spraying apparatus according to the present invention has two opposed electrodes in a housing adjacent to the path of a spray from a spray nozzle and a barrier adjacent to each electrode. The barrier includes pointed protuberances arranged so that the liquid collecting on them is discharged electrostatically. Each housing is secured to the barrier by a support extending from a recess within the housing.

11 Claims, 5 Drawing Figures

ELECTROSTATIC SPRAYING APPARATUS

This invention relates to electrostatic spraying apparatus, particularly but not exclusively to inductively chargeable spraying apparatus of the kind used for agricultural and horticultural purposes. Electrostatic spraying apparatus also find industrial applications, for example for paint spraying.

The advantages of electrostatic spraying are clearly illustrated by the applicability of the apparatus to agriculture. Induction of charges of like polarity on the spray droplets inhibits coalescence of the droplets and enhances attraction of the droplets to uncharged foliage. Attraction to under-surfaces of foliage is particularly important since these surfaces may not become into contact with simple sprays. Furthermore, large droplets formed by coalescence are less biologically active than small droplets.

U.K. Patent Specification No. 2140711 disclosed spraying apparatus comprising a spray nozzle, one or more electrodes disposed adjacent the path of spray emergent in use from the nozzle and a barrier adjacent the said one or more electrodes adapted to reduce contact of the spray with the electrodes, the barrier comprising one or more pointed protuberances arranged so that liquid draining in use from the barrier collects at said protuberances and is discharged from the latter by action of an electrostatic field.

The present invention is concerned with improvements to the previously disclosed apparatus.

According to the present invention spraying apparatus comprises a spray nozzle, one or more electrodes disposed adjacent the path of spray emergent in use from the nozzle and a barrier adjacent the said one or more electrodes adapted to reduce contact of the spray with the electrodes, the barrier including one or more pointed protuberances arranged so that liquid draining in use from the barrier collects at said protuberance and is discharged from the latter by the action of an electrostatic field, wherein the or each electrode is contained in a housing secured to the barrier by means of a support extending from a recess within the housing.

The support is preferably spaced from and partially enclosed by the housing within the recess. The support may be provided with one or more baffles to impede any flow of liquid and prevent direct electrical tracking along the support.

Location of the support within a recess in the electrode housing shelters the support from airborne droplets of spray or particles of dirt.

It is preferred that the one or more baffles are also located within the recess. The baffles may be provided with sharp edges to further impede any flow of liquid and to enhance the electrostatic insulation of the electrode.

In especially preferred embodiments of this invention the one or more electrodes have a greater dimension in a direction perpendicular to the direction of flow of the spray than in the direction of the flow of spray.

The electrodes are preferably elongate across the direction of flow of the spray. This serves to ensure that the spray is charged across the full width thereof without recourse to an inefficiently large electrode area.

The electrode housing may be adapted to maintain an unbroken stream of liquid between the electrode and the pointed protuberances. This serves to maintain a high electrical charge at the protuberances by conduction through an aqueous spray composition. The surfaces of the housing facing the spray is preferably generally flat or may be provided with drainage channels or ribs.

The invention is further described by means of example and not in any limitative sense, with reference to the accompanying drawings, of which:

The same reference numerals have been used in each Figure to denote like parts of the apparatus.

Figure 1:
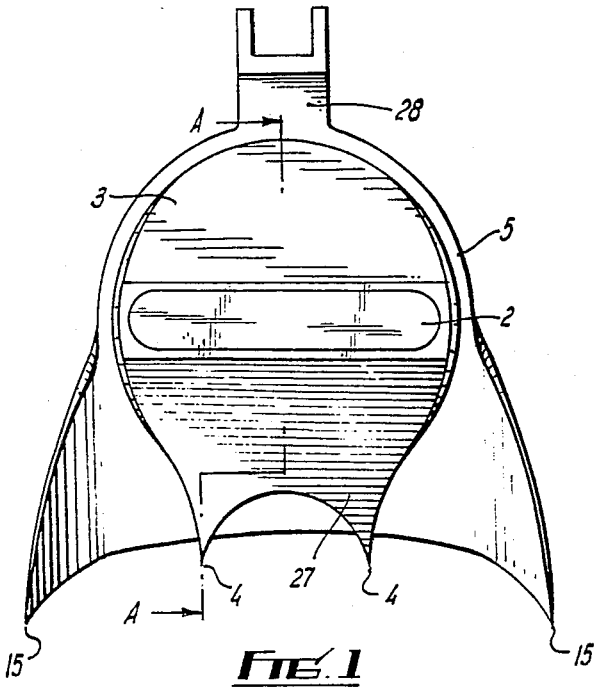
FIG. 1 shows an electrode and shroud of a spraying apparatus in accordance with this invention.
Figure 3:
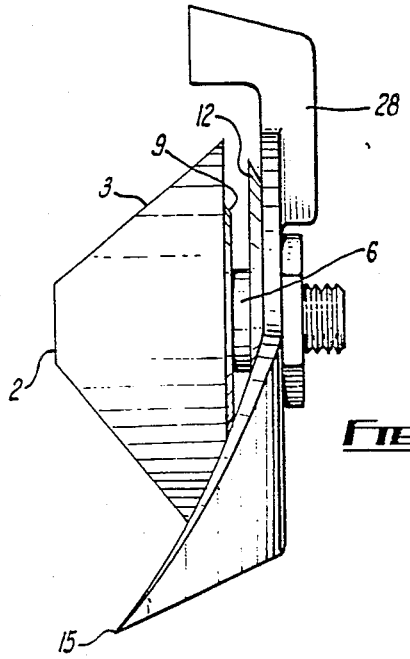
FIG. 3 is a side elevation of the electrode and shroud.
Figure 2:
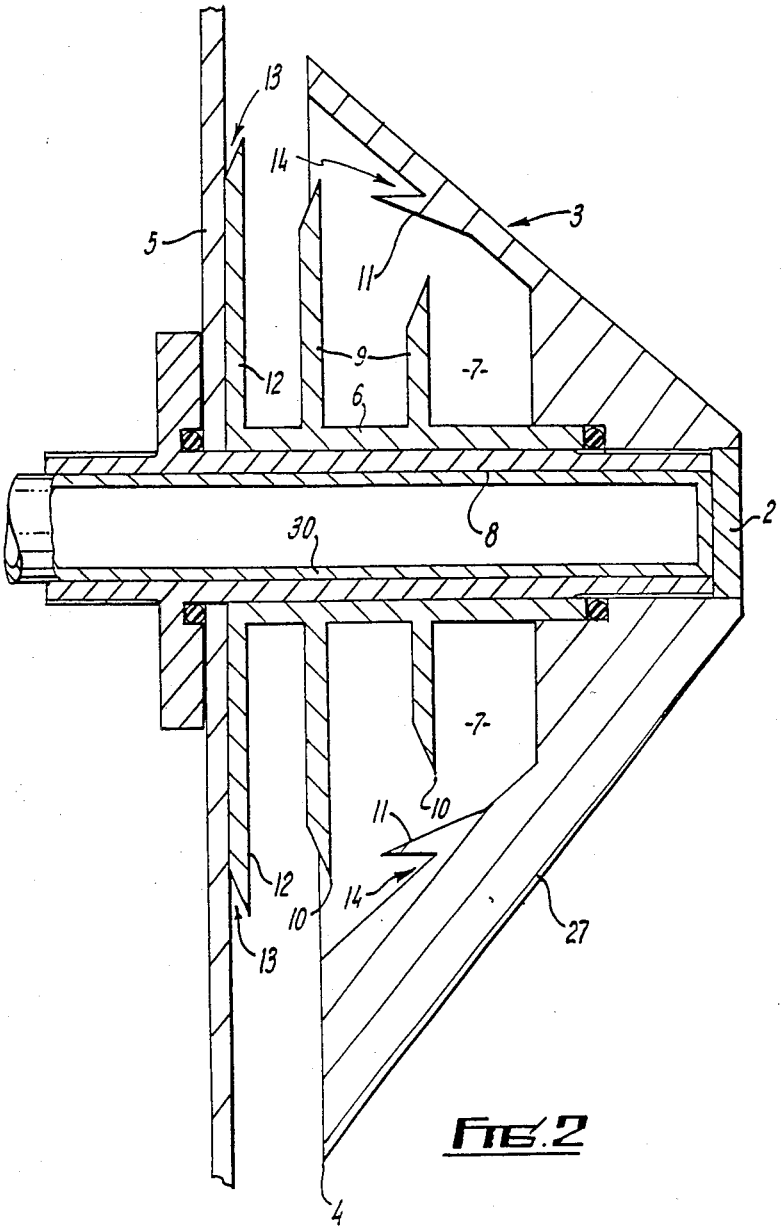
FIG. 2 is a cross-section on A—A of FIG. 1.

The electrode assembly shown in FIGS. 1 to 5 comprises a spray nozzle 1 arranged to deliver a spray between two opposed electrode faces 2. The body of liquid is earthed, for example at the supply tank. Electrical charges induced on the spray due to the proximity of the electrodes cause mutual repulsion of the droplets of the spray, preventing formation of large drops. Adherence of the droplets to the surfaces of crops is enhanced. In addition the droplets are attracted to vertical or undersurfaces of foliage which might otherwise be sheltered from the spray. The charge induced by the electrodes has an opposite polarity to that of the electrodes. The finest droplets of the spray which tend to form a cloud are attracted to the electrodes and collect thereon.

The electrodes 2 are each mounted in an insulating housing 3, composed, for example, of the plastics material marketed under the trade mark DELRIN.

The lowest portions of the housing comprise two downwardly pointed projections 4, the remainder of the housing being generally rounded and not having pointed surfaces. The projections are positioned to provide an equal mass of redistributed material across the centre portion of the spray pattern. Liquid draining to the projections 4 is caused to disperse as droplets due to the action of the electric field at the points. Very high electrical stress at the projections has been found to be undesirable because the droplets released from the electrodes have an opposite charge to that induced in the main spray. It is detrimental to cause atomisation of the droplets from the electrodes to an extent beyond that required to render them airborne, since mixture of the oppositely charged droplets reduce the overall effectiveness of the apparatus.

The electrode 2 is arranged to be located adjacent the region where the spray from the nozzle 1 breaks into droplets. The electrode is elongate in direction across the width of the spray, usually generally perpendicular to the direction of movement of the liquid in a fan-shaped spray. In an alternative embodiment of the invention the electrodes 2 may be curved to at least partially surround the spray formed by a cone, anvil or stream jet. Use of elongate electrode faces enables alternative nozzles to be employed, for example rotary atomisers. In addition the spatial volume of the electrostatic field is increased.

The lower region of the front face 27 of each electrode housing 3 is flat to facilitate formation of an unbroken stream of liquid between the electrode 2 and the points 4, allowing electrical charge to reach the points by conduction. Drainage channels such as shallow grooves in the surface of the faces 27 may be provided to enhance conduction to the points 4.

Each electrode housing 3 is mounted upon a shroud 5 by means of an insulating support 6. The housing 3 is hollow, having a recess 7 in the rear face, the support 6 extending into the recess and being secured to the housing at the deepest part thereof. The contact for the electrode 2 from the HT supply takes the form of a hollow rod shaped connector within an insulating tube 8 disposed within the support 6, through an aperture in the shroud 5. Connection of the HT supply to the electrode 2 immediately behind the face thereof is preferred to maximise the electric field at that point. The HT supply is preferably provided as an integral insulated assembly so that the contact with the electrode is the only point at which leakage can occur. The support 6 carries a plurality of disc like radial extensions 9 which serve to prevent flow of liquid along the support. The circumferences of the discs have sharp edges 10 which serve to cause a maximum impediment to flow of liquid and increase the electrical isolation of the electrode from the shroud. A plate-like or disc-like laminar portion 12 of the support abuts the shroud 5, this also having a pointed circumference. The interior of the recess 7 is also provided with an outwardly facing pointed annular formation 11 to enhance the electrical and mechanical isolation of the electrode.

The laminar portion 12 and annular formation 11 both define annular gutters or channels 13,14 which serve to collect liquid draining along the surfaces of the shroud 6 or recess 7 respectively. Liquid collected in the gutters is conducted to the lowermost portions in the gutters from which it may drain to the pointed projections of the housing or shroud as the case may be. Flooding of the support 6 is thereby avoided.

Location of the support 6 and radial extensions 9 within the recess 7 of the housing substantially prevents deposition of spray on them.

Figure 4:
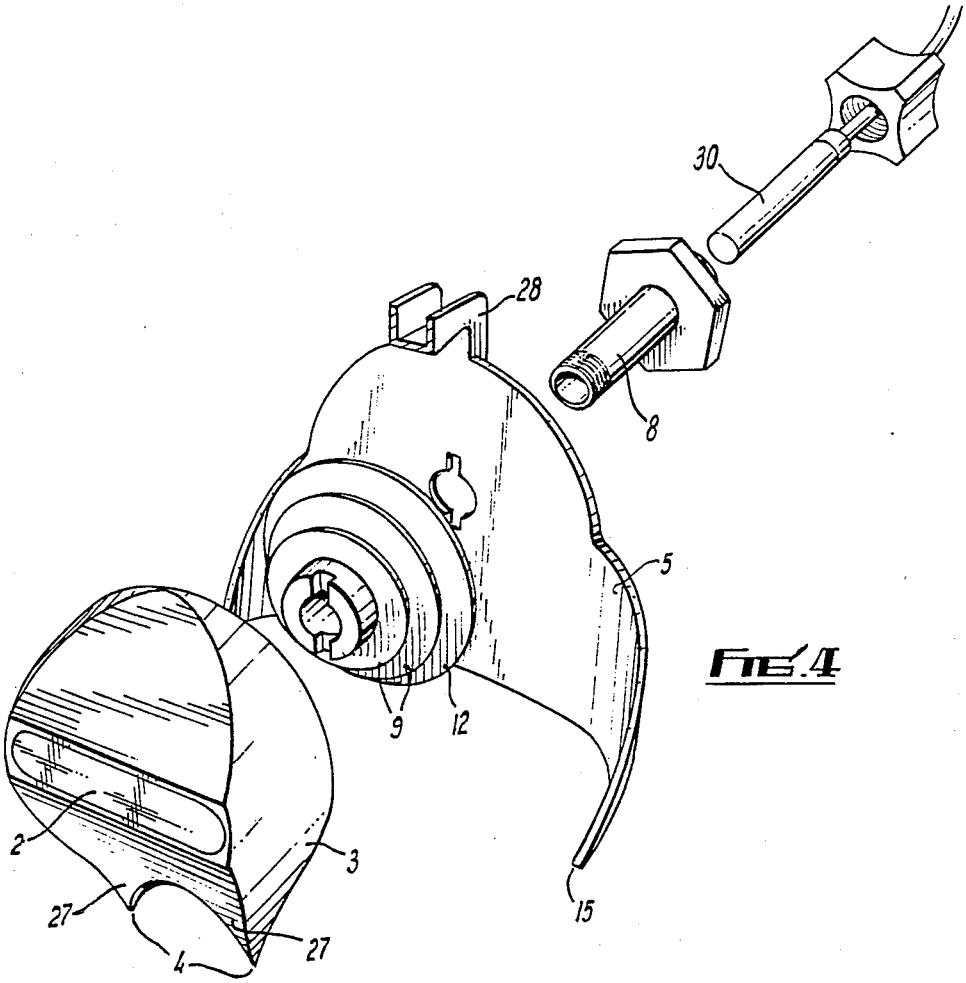
FIG. 4 is an exploded perspective view of the electrode and shroud.

Alternative embodiments of this invention may include drainage ribs or channels upon the surface of the shrouds to direct flow of liquid away from the electrode supports. This feature, the internal angle of the hollow recess, the external angles of the face of the electrode housing and the provision of the gutters 13 and 14 enables apparatus in accordance with this invention to be inclined at an angle to the vertical during use, rather than being confined to spraying in a vertical direction as shown in FIG. 4. Spraying at any angle between the vertical and horizontal is possible. Spraying at an angle ahead or behind the direction of travel of spraying apparatus across the ground may be convenient to improve the degree of interception and coverage of under surfaces of foliage and vertical surfaces of plant stems which are connected to form a single assembly.

The half portions 5 of the shroud each partially enclose a respective electrode, preventing deposition of spray on the latter. Each half portion of the shroud has two downwardly pointed projections 15 located outwardly of the projections 4 of the electrode housing. Liquid collected upon the shroud drains to the points 15 and is released back into the spray by action of the electrostatic field. The points 15 and 4 are disposed in spaced relation so that the liquid dispersed from them is evenly re-distributed within the spray pattern.

The shroud is preferably arranged to closely surround the electrode housings in order to minimise the aerodynamic resistance of the apparatus, in order to facilitate use in air assisted spraying applications. The support portions 28 of the shrouds preferably occupy a minimal volume so that air flow through the spray head is not impeded.

The shroud is arranged to be secured to the spray nozzle assembly by means of a supporting ring 16.

A multiplicity of spraying heads as shown in FIGS. 1 to 4 may be disposed on the boom. Electrical connection between the heads may be conveniently achieved by means of a loom of modular connectors.

Figure 5:
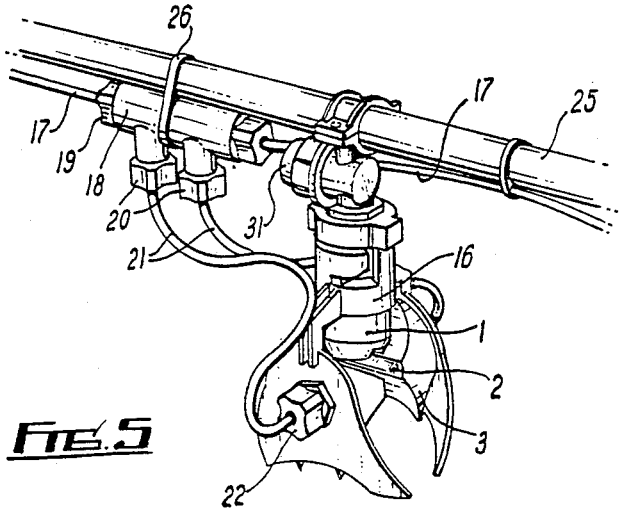
FIG. 5 shows the complete spray head mounted on a boom.

FIG. 5 illustrates a preferred arrangement in which the conductor 17 from the HT supply is connected to a plastics insulated terminal block 18 by means of a threaded connector 19. Connection to the two electrodes of a spray head is achieved via individual conductors 21 by means of two knurled threaded connectors 20 which may carry gold or silver plated terminal members. Each terminal is sealed within the terminal block 18 by a PTFE, DELRIN (Registered Trade Mark) or other plastics sleeve and a sealing ring. The terminal blocks 18 may be connected in series along a tubular boom 25 by means of clips or other fasteners 26 as shown in FIG. 10. Similar terminal members 22 may be used for connection to the electrodes.

Liquid supply to the spray nozzle is by means of a pipe (not shown) connected to an inlet 31.

Conventional spraying apparatus may deliver 220 liters of aqueous solution per hectare at 300 kP pressure through a 110° flat fan nozzle on a horizontal spray boom moving at a speed of about 2 $ms^{-1}$.

Use of the more efficient apparatus in accordance with this invention allows 100 to 110 liters per hectare to be delivered at a pressure of 400 kP using a 110° flat fan nozzle. Use of a higher pressure produces smaller droplets than has hitherto been possible. Furthermore, the head may be inclined by up to 45° without flooding the electrodes.

Table 1 illustrates the superior performance of the present invention in comparison to that disclosed in our U.K. Patent Specification No. 2140711.

TABLE 1

| System | Spray Pressure (kP) | Voltage (kV) | Nozzle | Charge/Mass (mC/kg) |
|---|---|---|---|---|
| Prior Art | 400 | 4 | 80015 | 0.158 |
| Present Invention | 400 | 4 | 80015 | 0.321 |
| Present Invention | 400 | 4 | 11001 | 0.547 |
| Present Invention | 285 | 4 | 110015 | 0.333 |
| Present Invention | 400 | 4 | 110015 | 0.387 |

Although very high charge/mass ratios can be obtained using very low flow rate nozzles, the small orifices of the latter are easily blocked. Use of a moderately low flow rate nozzle (e.g. a 110015 nozzle as measured on the Spraying Systems Inc. scale) at a higher than normal pressure e.g. 400 kP, results in a smaller range of droplet sizes than a slightly lower flow rate nozzle (e.g. 11001) used at the usual pressure of 285 kP. A surfactant was incorporated into the solution in order to enhance production of optionally sized droplets, reduced the "back charge" loss of liquid from the plant once the drops have impinged upon the surface thereof and increased spread or wetting of the individual drops on the plant surfaces.

The following experimental data illustrate the advantages gained from use of the present invention in contrast to conventional spraying apparatus.

The trials were performed at various locations in the United Kingdom during 1985.

The following operating conditions were used:

Operating voltage—4 kV

Operating pressure—$4\times10^5$ $Nm^{-2}$

Nozzles—110015 or equivalent

Forward speed—7.2 kph (4½ mph)

Nozzle height—As recommended by individual nozzle manufacturer.

Amount of Wetting Agent—0.5% v/v

Nozzle angle—Vertical or 45°

'Standard treatments' for each trial were taken to be whatever would be 'normal' commercial practice for the crop, type of treatment, and timing of application. In general this was taken to be full dose rate, 200 l/ha water, 110° jets, 40 psi spraying pressure, no wetter and 7 kph forward speed. Wind speeds were also recorded as this has an effect on spray deposition, as well as the direction from which the wind was coming relative to the direction of spraying.

The following abbreviations are used:

HNS=Hydraulic Nozzle Standard. 200–242 l/ha at 3–4 bar (normally an 11003 jet)

EX=The present invention. 100–118 l/ha at 4 bar (i.e. a lower density of application).

CHARGE/MASS RATIO MEASUREMENTS

The measurements of charge/mass ratio for any electrostatic spraying system is difficult for a number of reasons. Such measurements are important because they indicate how efficiently the system is working, being an indication of the amount of electrical charge carried by the spray. The measurements are very subjective in naure. The testing of Q/m (charge/mass ratio) is effected by humidity, electrical storms etc. Absolute figures for Q/m do not exist. Measurements taken by one group of workers with one piece of equipment cannot be compared with those from another group. However, Q/m measurements performed using the EX system showed basic repeatable trends.

The use of brass (or any other metal) tips gave about 30% higher Q/m figures than the use of plastic (specifically Kematal) tips. This is thought to be an affect of conductivity actually through the nozzle tip itself, allowing the fan jet spray to earth more efficiently through the sprayline.

A 0.1% wetter concentration appeared to give slightly higher Q/m readings than 0.5% v/v. The reasons for this are not known, but probably relate to the size of droplets initially produced by the spray tip. In the field, the biological advantages of the 0.5% wetter concentration would outweigh the loss in effective Q/m.

DROPLET SIZING TEST WITH EX SYSTEM

Droplet sizing tests were carried out with the conventional Malvern 2600 HSD apparatus and Particle Measuring Systems OAP-260X laser probe.

| Nozzle | kV | % volume in size classes 25 μm | 50 μm | 100 μm | Max. size μm |
|---|---|---|---|---|---|
| Droplet sizing using Malvern 2600 HSD (all with 0.5% wetter at $4\times10^5$ $Nm^{-2}$) | | | | | |
| 110015 | No | 3.48 | 15.20 | 53.40 | 271 |
| 110015 | Yes | 1.64 | 10.79 | 54.50 | 218 |
| 11003 | No | 2.05 | 8.78 | 33.50 | 373 |
| 11003 | Yes | 1.65 | 8.61 | 38.65 | 296 |
| Droplet sizing using Malvern 2600 HSD (all with 0.5% wetter at $3\times10^5$ $Nm^{-2}$) | | | | | |
| 110015 | No | 3.02 | 13.30 | 48.30 | 290 |
| 110015 | Yes | 1.58 | 9.71 | 48.12 | 241 |
| 11003 | No | 1.82 | 7.76 | 30.0 | 400 |
| 11003 | Yes | 1.41 | 7.64 | 35.87 | 302 |

-continued

| Nozzle | kV | Pressure ($10^5$ $Nm^{-2}$) | VMD μm | NMD μm | SauterMD μm |
|---|---|---|---|---|---|
| Droplet sizing using Particle Measuring Systems OAP-260X (all with 0.1% wetter) | | | | | |
| 110015 | No | 4 | 215 | 22.4 | 185 |
| 110015 | Yes | 4 | 197 | 35.4 | 171 |
| 8001 | No | 3 | 212 | 27.0 | 191 |
| 8001 | Yes | 3 | 202 | 50.4 | 181 |

VMD = Volume Median Diameter
NMD = Number Median Diameter
SauderMD = Sauter Median Diameter In all instances charging tended to reduce the number of the smallest droplets, and reduce the maximum droplet size of the spray i.e. it tended to diminish the two extremes of the spray spectrum, yet still leave a useful 'mid range' which was increased in proportion. This has obvious effects in terms of the useability of the spray (i.e. minimising wastage), and reduction in fine droplet drift.

OIL SEED RAPE TRIALS USING EX SYSTEM

Deposition of fluorescent tracers was measured in commercial crops of oil seed rape sprayed at two different growth stages. This work was supported by a trial carried out using a triazol plant growth regulator.

Spray deposition in oil seed rape (at flowering - ADAS GS 4)

| Treatment | kV | Wetter conc. % v/v | Top. μg/g | Middle. ng/cm² | Base. ng/cm² | Whole Plant μg/g |
|---|---|---|---|---|---|---|
| EX | Yes | 0.5 | 42.0 | 62.3 | 25.3 | 12.15 |
| EX | No | 0.5 | 27.4 | 55.8 | 23.8 | 9.64 |
| HNS | No | 0.5 | 16.3 | 56.1 | 26.5 | — |
| HNS | No | 0 | 15.7 | 52.5 | 24.9 | 8.90 |

Spray deposition in oil seed rape (at seed formation - ADAS GS 6; all treatments include 0.5% v/v wetter)

| Treatment | kV | Pod upper ng/cm² per g/ha applied | Pod lower | Plant base |
|---|---|---|---|---|
| HNS | No | 0.67 | 0.28 | 0.21 |
| EX | No | 1.61 | 0.32 | 0.16 |
| EX | Yes | 2.07 | 0.42 | 0.27 |
| EX at 45° | Yes | 3.11 | 0.45 | 0.27 |

At both growth stages there was an increase in physical deposition throughout the crop using the EX system. This was most noticeable at the top half of the pod carrying level, but also occurred at the lower half of the plant where use of low water volumes uncharged tended to reduce spray deposition, Charging more than compensated for this loss of basal coverage.

Treatment of oil seed rape with an experimental plant growth regulator.

| Treatment | kV | Wetter conc. % v/v | Yield. t/ha | Relative increase t/ha |
|---|---|---|---|---|
| EX | Yes | 0.5 | 3.08 | +0.55 |
| HNS | No | 0 | 2.88 | +0.35 |
| EX | No | 0.5 | 2.67 | +0.14 |
| Unsprayed control | | | 2.53 | |

CEREAL TRIALS

Spray deposition in cereals

Fluorescein was sprayed onto barley at the growth stage; GS 39-51 using three different application techniques—conventional hydraulic application at 200 l/ha, EX at 100 l/ha and rotary atomizer at 10 l/ha. The following results are presented as retention relative to the standard hydraulic application (11003 nozzle used at 3 bar, i.e. standard = 1).

| Treatment | kV | Ear + flag | Stem | Leaf 1 | Stem | Leaf 2 |
|---|---|---|---|---|---|---|
| EX | Yes | 1.77 | 1.87 | 1.27 | 1.90 | 1.27 |
| EX | No | 1.29 | 1.10 | 1.40 | 1.29 | 1.80 |
| CDA | No | 0.79 | 0.69 | 1.34 | 1.38 | 1.43 |

(CDA = Controlled Droplet Applicator/Rotary Atomiser)

In addition, fluorescein recoveries were made from whole plant samples, and these looked as follows:

Standard = 150 ng/cm$^2$

EX charged = 249 ng/cm$^2$

EX uncharged = 231 ng/cm$^2$

CDA = 205 ng/cm$^2$

Charging caused application of more material on thinner surfaces such as stems. The crop was mature and dense and little chemical was lost to the environment. Changes in total recovery were less than they would be in more open crops. However, there were significant differences which indicated an increase through volume reduction and charging. Charging tended to put the material where it was most needed at the particular crop growth stage chosen.

DISEASE CONTROL IN WINTER BARLEY

The winter barley variety, Sonja, was sprayed with a programme of fungicide sprays using a variety of application techniques. In each trial area, the two consecutive treatments (of Tilt 250EC at GS 30.31 and Tilt Turbo at GS 37.51) were applied using the same application technique. The remaining Green Leaf Area on the flag leaf was measured on 24/6/85.

| Treatment | kV | Wetter conc. (% v/v) | Pressure. ($10^5$ Nm$^{-2}$) | Green Leaf Area on flag leaf | Yield t/ha |
|---|---|---|---|---|---|
| HNS | Yes | 0.5. | 4 | 39 | 8.04 |
| EX | Yes | 0.5 | 4 | 40 | 7.94 |
| HNS | No | 0.5 | 4 | 32 | 7.90 |
| EX | No | 0.5 | 4 | 28 | 7.86 |
| EX | No | 0 | 4 | 29 | 7.76 |
| HNS | No | 0 | 4 | 19 | 7.62 |
| Unsprayed control | | | | 4 | 6.74 |

BROAD-LEAVED WEED CONTROL IN WINTER BARLEY (Halcyon winter barley at GS 31)

This crop of thick barley was sprayed on 24/4/85 with a formulation of ioxynil, bromoxynil and mecoprop (Swipe 560SCW). Weeds were large and actively growing: chickweed up to 15 cm across, 38% ground cover, red dead-nettle, 4 whorls at 22/m$^2$; poppy, up to 8 leaves at 44/m$^2$; and a few speedwell, pansy and forget-me-not. The full dosage was 4.5 l/ha.

Weed assessment - 10/6/85 - dry weight of weeds (g/m$^2$).

| Treatment | kV | Wetter conc. (% v/v) | Pressure ($10^5$ Nm$^{-2}$) | Dosage of herbicide (Full) | Dosage of herbicide (⅓) |
|---|---|---|---|---|---|
| EX | Yes | 0.5 | 4 | 23.9 | 55.4 |
| EX | No | 0.5 | 4 | 58.4 | 65.2 |
| HNS | Yes | 0.5 | 3 | 34.2 | 64.2 |
| HNS | No | 0.5 | 3 | 37.6 | 66.9 |
| Unsprayed control | | | | 136.8 | |

Yield of grain t/ha at 15% moisture content

| Treatment | kV | Wetter conc. (% v/v) | Pressure. ($10^5$ Nm$^{-2}$) | Dosage of herbicide (Full) | Dosage of herbicide (⅓) | Mean |
|---|---|---|---|---|---|---|
| EX | Yes | 0.5 | 4 | 6.44 | 6.33 | 6.38 |
| EX | No | 0.5 | 4 | 6.10 | 5.95 | 6.02 |
| HNS | yes | 0.5 | 3 | 6.38 | 6.16 | 6.27 |
| HNS | No | 0.5 | 3 | 6.24 | 6.22 | 6.23 |
| Unsprayed control | | | | 5.63 | | |

There was an increase in yield from all the herbicide treatments when compared with the untreated crop. Charging the low volume Ex nozzle, which improved weed control significantly increased yield, whereas charging the conventional 11003 nozzle did not significantly affect the weed control or yield.

There was an increase in yield from all the herbicide treatments when compared with the untreated crop. There was no significant difference however between any of the treatments in terms of final yield, whether charged or uncharged, full or third rate.

I claim:

1. A spraying apparatus, comprising: a spray nozzle, at least one of a plurality of electrodes disposed adjacent a path of spray emergent in use from the nozzle, said electrodes being elongate across the direction of the path of spray, and an electrode housing enclosing said at least one of a plurality of electrodes and disposed adjacent to said at least one of a plurality of electrodes, the electrode housing further comprising at least one of a plurality of pointed protuberances depending therefrom, a barrier shroud having at least one of a plurality of pointed protuberances extending outwardly therefrom, said barrier shroud being removably secured to said electrode housing by support means for supporting said barrier shroud, said electrodes and said electrode housing, said barrier shroud extending from a recess within the electrode housing and at least partially enclosed thereby, said support means further comprising at least one of a plurality of pointed baffles extending radially therefrom.

2. Spraying apparatus as claimed in claim 1, wherein said electrode housing further comprises a substantially planar facing between said electrode and said protuberances said electrode housing being proximately disposed to said electrode to create an unbroken stream of liquid therebetween.

3. A spraying apparatus for spraying a liquid, comprising:

spray nozzle means for directing a spray of a liquid, at least one electrode disposed adjacent to a path of said liquid emerging from said nozzle said at least one electrode having an elongate configuration perpendicular to said path of liquid emerging from said nozzle, barrier means disposed generally adjacent to each of said electrodes for minimizing contact of said spray with said electrodes said barrier means further comprising a plurality of pointed protuberances extending outwardly therefrom, and housing means, having a plurality of pointed protuberances depending therefrom, for containing said electrodes therein, said housing means being removably secured to said barrier means by a support member having a plurality of radial baffles extending therefrom, said support member extending from a recess within said housing means.

4. The Spraying apparatus as claimed in claim 3, wherein said support member is spaced from and partially enclosed by the housing means.

5. The spraying apparatus as claimed in claim 4, wherein each of said radial baffles has a sharp edge.

6. The spraying apparatus as claimed in claim 3, wherein said housing means is proximately disposed to said electrode to create an unbroken stream of liquid between said electrode and said pointed protuberances of said housing means.

7. A spraying apparatus for spraying a liquid, comprising:

a spray nozzle, at least one of a plurality of electrode means disposed adjacent to a path of liquid spray emergent in use from said nozzle for imparting an electrostatic field thereby atomizing said liquid each of said electrode means having a greater dimension in a direction perpendicular to the direction of said flow of spray than in the direction of said flow of spray, a barrier disposed adjacent to each of said plurality of electrodes, said barrier having a plurality of curved pointed protuberances extending outwardly toward said flow of spray, said barrier being disposed in close proximity to said flow of spray to be capable of collecting liquid draining in use, channelling said liquid to said curved pointed protuberances and discharging said liquid from said curved pointed protuberances by the action of said electrostatic field, a housing removably secured to said barrier by a support member extending from a recess within said housing said support member further having a plurality of radial baffles extending therefrom wherein said support member is substantially enclosed by said housing, and electrical connector means for imparting an electrical current to each of said electrodes, said electrical connector means being operably engaged with each of said electrodes.

8. The spraying apparatus as claimed in claim 7, wherein said radial baffles are located within said recess within said housing means.

9. The spraying apparatus as claimed in claim 7, wherein each of said radial baffles has a sharp edge.

10. The spraying apparatus as claimed in claim 7, wherein said housing further comprises at least one of a plurality of pointed protuberance means for collecting said liquid draining in use from said housing and discharging said liquid from said pointed protuberance means by action of an electrostatic field.

11. The spraying apparatus as claimed in claim 10, wherein said housing is proximately disposed to said electrode to create an unbroken stream of liquid between said electrode and said protuberances of said housing.

* * * * *